US005494538A

United States Patent [19]

Kirillov et al.

[11] Patent Number: 5,494,538

[45] Date of Patent: Feb. 27, 1996

[54] MAGNESIUM ALLOY FOR HYDROGEN PRODUCTION

[75] Inventors: Vladimir I. Kirillov, St. Petersburg - Petrodvoretz; Alexander N. Vastrebov, St. Petersburg, both of Russian Federation

[73] Assignee: Magnic International, Inc., Raleigh, N.C.

[21] Appl. No.: 181,674

[22] Filed: Jan. 14, 1994

[51] Int. Cl.[6] ..... C22C 23/00

[52] U.S. Cl. ..... 148/420; 420/411; 420/412; 420/413

[58] Field of Search ..... 148/420; 420/411, 420/412, 413

[56] References Cited

U.S. PATENT DOCUMENTS

| | | | |
|---|---|---|---|
| 2,011,613 | 8/1935 | Brown et al. | 420/413 |
| 3,985,865 | 10/1976 | Hohne | 423/657 |
| 4,072,514 | 2/1978 | Suzuki | 75/168 |
| 4,179,287 | 12/1979 | Kosto | 420/413 |
| 4,600,661 | 7/1986 | Dohnomoto et al. | 428/614 |
| 4,765,837 | 8/1988 | Whitehead | 420/411 |
| 4,938,809 | 7/1990 | Das et al. | 148/406 |
| 5,304,260 | 4/1994 | Aikawa et al. | 148/403 |

OTHER PUBLICATIONS

Supercorroding Alloys for Generating Heat and Hydrogen Gas; Sergev and Black; conference proceedings, 1977.

*Primary Examiner*—John Sheehan
*Attorney, Agent, or Firm*—Olive & Olive

[57] ABSTRACT

The invention relates to a hydroreactive magnesium mixture preparation for producing hydrogen. The preparation contains magnesium, causing generation of hydrogen, as catalyst nickel and, possibly, cobalt and/or manganese, and as additional component, zinc, which is employed as a passivating agent.

5 Claims, No Drawings

MAGNESIUM ALLOY FOR HYDROGEN PRODUCTION

BACKGROUND OF THE INVENTION

1. Field of the Invention

The present invention relates to a magnesium mixture capable of producing hydrogen when reacting in an aqueous solution containing one or several chlorinous salts.

2. Description of Prior Art

The invention is generally associated with hydrogen power plant technology and specifically with metal compounds referred to as hydroreactive materials and which cause hydrogen generation when reacting with an aqueous solution.

An aqueous solution containing chlorinous salt is in this context understood to be an aqueous solution containing one or several chlorinous salts, such as NaCl or KCl, e.g. at concentrations such as are found in sea water, such as 0.5 to 5.0% by weight.

Though the state of art several different hydrogen-producing processes are known, e.g. electrolysis of water carbon processing by applying known water gas reactions, processing of natural gas, and hydrogen extraction from metal compounds.

Hydrides constitute a class of metal compounds, and they serve as sources of alkali metals, earth alkali metals and metal alloys based on these, etc. (G. Alefeld and I. Fenkel, Vodorov v metallakh, The Mir Publishers, Moscow, 1981, p. 241–275). Hydrides absorb hydrogen under certain conditions, while they release it under other conditions.

Hydrides are expensive hydrogen-producing sources since the metals contained in the hydrides are high in price and preparation of hydrides, as well as the technology associated with hydrogen production with the aid of hydrides, is expensive.

Of hydroreactive materials may be mentioned, for instance, a hydroreactive preparation based on aluminium (USSR, Inventor's Certificate No. 1470661, CO1B 3/08, published Jul. 4, 1989), containing aluminium as metal causing hydrogen generation and a catalyst, selected from the group comprising lithium and sodium and lithium hydrides, and which is used in a quantity amounting to 15–50% by weight. The preparation is a highly efficient hydrogen source. However, it requires special storage conditions because its resistance to corrosion in air is poor. Moreover, the preparation commands a high price. These drawbacks are due to lithium and sodium, which are highly reactive, and expensive, metals and the concentration of which in the preparation may be up to 50%.

In the patent application JA 58-14361, published 18.03.1983, a procedure for preparing a hydrogen-producing hydroreactive preparation is described. In the procedure, aluminium is heated and gallium is introduced therein for catalyst. In order to introduce the catalyst into the aluminium, the aluminium is rolled to a thin sheet and heated at a temperature which is below its melting point but higher than the melting point of gallium. Gallium is applied on the surface of the heated aluminium, where it melts and forms a coating. The composite material hereby obtained is cooled and rolled once more, whereafter it is either pelletized or comminuted in another way. The procedure requires much labour and energy. In the preparation expensive catalyst material is used in excess. The excess quantity has no direct effect on the hydrogen generating process, but it affects the process costs substantially. The product turned out by this method presents poor resistance to corrosion in air, and it requires special storage conditions.

The U.S. Pat. No. 4,072,514 Suzuki, describes a procedure for preparing hydroreactive magnesium mixtures. In the procedure, iron or iron oxide powder in solid form is admixed to molten magnesium, for catalyst. However, the corrosion resistance, and thus the usability in practical applications, of the product is highly questionable. Furthermore, it is mentioned in a general way in the disclosure part of the reference that the same effect is achieved with use of zinc, chromium or manganese for catalyst as with iron. No examples are however presented of the functioning of these metals.

The high price of hydroreactive preparations of prior art, the complexity of their manufacturing, poor corrosion resistance and, for instance the storage problems therewith associated are significant drawbacks with a view to their industrial production and their applicability in practice.

SUMMARY OF THE INVENTION

The object of the present invention is to bring forth a novel hydroreactive preparation which presents high hydrogen producing efficiency, and which moreover is advantageous as to production cost.

The object of the invention is, further, to bring forth a novel hydroreactive substance which presents excellent resistance to corrosion in air.

Furthermore, the object of the invention is to bring forth a novel hydroreactive preparation which is well appropriate for use in industrial production and in practical applications.

The object of the invention is moreover to disclose a procedure for preparing such a substance.

It is thus understood that the invention discloses a magnesium mixture capable of inducing generation of hydrogen when reacting with water in the presence of a chlorine-containing salt, said magnesium mixture comprising minor quantities of one or more metals as catalyst, whereby said magnesium mixture comprises:

(a) more than 0.4% by weight of nickel as a catalyst and, additionally, (b) more than 0.015% by weight of zinc as passivating agent.

It was found in studies made in connection with the present invention that nickel serves as an excellent catalyst for increasing the hydrogen producing efficiency of magnesium. When nickel was used, the hydrogen production was found to be superior to that in the case of the iron catalyst according to the Suzuki reference cited above, U.S. Pat. No. 4,072,514.

It was further unexpectedly found that on addition of zinc to the mixture, zinc unexpectedly elicited a passivating effect on the product, so that zinc acted in the hydroreactive magnesium mixture as a corrosion resistance-enhancing agent, i.e., use of zinc prevented the magnesium/nickel mixture from reacting e.g. with atmospheric humidity. Yet zinc was not noted to impair the desired good hydrogen production capacity of the magnesium/nickel mixture in spite and said protective effect. The observation thus made is contrary to what is presented in said reference by Suzuki, U.S. Pat. No. 4,072,514, in that in said reference zinc was presented as a hydrogen generation-catalyzing metal equivalent to iron, and its use instead of iron was suggested. The advantages achievable with zinc in corrosion resistance cannot be inferred from the reference; much sooner the reference demonstrates that generalisations and conclusions from known technology can be misleading.

In the magnesium mixture of the invention the upper limits of nickel and zinc are not confined, and they may be up to 5 or 10% by weight, or even higher, yet more advantageously about 0.5 to 3.5% by weight nickel and about 0.02 to 0.5% by weight zinc. In said advantageous quantities, nickel and zinc are favourable in price, and therefore the magnesium mixture of the invention is advantageous, as to its material cost, compared with any other usable hydroreactive preparations. Since moreover good hydrogen production and good corrosion resistance in air are attained with the combination of the invention, this mixture is highly advantageous with a view to industrial production and practical applications.

It was further observed in connection with the invention that the magnesium mixture of the invention may contain as additional catalyst, i.e., in addition to nickel, manganese e.g. up to 1.5% by weight, e.g. 0.5 to 1.5% by weight, and/or cobalt e.g. up to 1.5% by weight, e.g. 0.5 to 1.5% by weight. The upper limit concentration has been stated in view of practical considerations, but said additional catalysts can be present up to 5 or 10% by weigth and even more. It is possible to replace e.g. part of the nickel with additional catalyst of favourable price, and thus to reduce even further the advantageous matérial cost of the product of the invention. The total catalyst quantity contained in the magnesium mixture is advantageously about 0.5 to 3.5% by weight in view of costs, but it may equally be higher, such as up to 5 or 10% by weight or more.

The invention further discloses a procedure for preparing a hydroreactive magnesium mixture producing hydrogen, in which magnesium is heated to molten state, zinc and catalyst are introduced in the melt, the melt is mixed, and it is solidified. The procedure is simple and advantageous in implementation, with a view to industrial production. Considering, moreover, the materials which are used and the low contents of catalyst and zinc, the manufacturing cost will be lower than in the general state of technology.

The functioning principle of the magnesium mixture of the invention is presumed to be based on the following, yet without commitment thereto. Catalysts which are usable in the invention, that is nickel and cobalt and/or manganese and mixtures of these, are able to produce in the crystal lattice of the magnesium region an over-voltage, varying in the range of 0.1 to 0.5 volts at current 3 mA/cm$^2$. The hydroreactive metal mixture of the invention has a crystalline structure incorporating micro-galvanic cells, which are uniformly distributed throughout the material. Magnesium constitutues the micro-anodes of these cells, and $Mg_6Ni$, $Mg_4Ni$ and other compounds of equivalent type are micro-cathodes. The catalyst produces in the regions of the crystalline structure a low hydrogen over-voltage, as was said in the foregoing. These regions are micro-cathodes of the micro-galvanic cells that have been formed, and they facilitate the nascence of hydrogen. Zinc, present in the magnesium mixture together with the selected catalyst, and acting as passivating agent, presumably evens out the thermal expansion coefficients of the metal contained in the material and the oxide film formed of zinc oxide. This protective oxide layer does not crack under effect of such temperature changes as occur in the preparation, nor will it lose its protective effect, and the preparation of the invention is consequently corrosion-resistant in air and in fresh (non-saline) water.

The catalyst quantity to be used depends on the desired rate of hydrogen generation, this rate in its turn depending on the composition of the preparation. Catalyst additions less than 0.5% by weight have not been found to produce the described structure everywhere in the hydroreactive preparation obtained, and in such cases the result is a clearly reduced hydrogen generating effect when the preparation reacts with sea water. Zinc additions to magnesium lower than 0.02% by weight seem to produce on the surface of the preparation an oxide layer which is not strong enough, whereby the corrosion resistance of the hydroreactive preparation is insufficient. The upper limits for the advantageous catalyst and zinc concentrations have been chosen from practical considerations: raising the upper limits of the catalyst and zinc concentrations does not increase the hydrogen generating effect or the corrosion resistance in proportion with the increased material costs.

The magnesium and the catalyst metal employed, and the zinc, are substantially pure. Minor impurities have no influence on the hydrogen producing capacity of the product.

DETAILED DESCRIPTION OF THE INVENTION AND PREFERRED EMBODIMENTS

The invention is described in greater detail in the following, with the aid of embodiment examples.

In the procedure for preparing a hydroreactive preparation according to the invention, magnesium is melted e.g. in an induction furnace or in a graphite crucible, or in another way, at a temperature higher than its melting point, which is 760° to 800° C., catalyst and zinc are introduced as additives, the components are thoroughly blended, using e.g. a mechanical stirrer, and the melt is then poured into a mould. Solidification yields an end-product, which may have rod, sheet, ribbon, etc. shape. The hydroreactive preparation may equally be shaped into chips or granules e.g. by cutting up the cast preparations, or by granulating the melt. In order to produce hydrogen, the hydroreactive preparation, e.g. in chip or granular form, is reacted e.g. with sea water, the reaction then proceeding more vigorously than has been reported in the state of art.

When the hydroreactive preparation of the invention is reacted e.g. with sea water or with a salt solution containing chlorine, the oxide film on the surface of the preparation loses its protective property, whereby the micro-galvanic cells, consisting of magnesium as micro-anodes and $Mg_6Ni$, $Mg_4Ni$ and compounds of equivalent type as micro-cathodes, create a short-circuit, and the preparation begins to react powerfully with water, producing magnesium hydroxide, hydrogen and heat:

$$Mg+2H_2O \rightarrow Mg(OH)_2+H_2+84.4 \text{ kcal}$$

The magnesium hydroxide is precipitated, exposing new material layers to the electrolyte. The microcrystalline structure of the preparation of the invention enables up to 99.9% hydrogen producing capacity because the hydration process involves all the elements of the preparation's structure everywhere in the preparation.

EXAMPLE 1

A fast reaction rate material, e.g. for blowing the ballasting system of a submarine.

20 kg magnesium, at least 9.5 % pure, were conveyed into an induction furnace. The charge was melted and 0.6 kg nickel, at least 95% pure, and 0.05 kg zinc, at least 95% pure, both in solid form, were added to the melt. The melt was mixed, using a mechanical stirrer, and poured into a mould. On solidification, the hydroreactive preparation thus obtained was placed in sea water. A hydrogen liberation reaction ensued, reaction rate 60 ml/cm$^2$.min.

EXAMPLE 2

A slow reaction rate preparation, for use e.g. in marine buoy hydrostats.

The preparation was made substantially as above described. The preparation thus obtained had the following composition: nickel 0.5% by weight, cobalt 0.2% by weight, zinc 0.05% by weight, and the rest magnesium. On placing the preparation in sea water, a hydrogen liberation reaction ensured, with hydrogen generation rate 10 ml/cm$^2$.min.

EXAMPLE 3

A medium reaction rate preparation for use, e.g., in internal combustion engines.

The preparation was made substantially as above described. The preparation thus obtained had the following composition: nickel 1% by weight, manganese 0.02% by weight, zinc 0.05% by weight, and the rest magnesium. On placing the preparation in sea water, a hydrogen liberation reaction ensued, with hydrogen generation rate 25 ml/cm$_2$.min.

The hydrogen liberation reaction took place under atmospheric pressure and at 100° C. in all cases.

The table following hereinbelow gives examples of the other hydroreactive preparations which were made and which are within the limits of component concentrations and beyond their limiting values.

TABLE

| Ex. No. | Mg, % b.w. | Ni % b.w. | Zn % b.w. | Mn % b.w. | Co % b.w. | Specific hydrogen quantity per unit area, ml/cm$^2$ · min | Hydrogen liberation capacity, % |
|---|---|---|---|---|---|---|---|
| 4 | 99.58 | 0.40 | 0.02 | — | — | 2.0 | |
| 5 | 99.47 | 0.50 | 0.03 | — | — | 10.0 | 99.0 |
| 6 | 99.45 | 0.50 | 0,05 | — | — | 10.0 | 99.0 |
| 7 | 98.97 | 1.00 | 0.03 | — | — | 20.0 | 99.2 |
| 8 | 96.75 | 3.00 | 0.25 | — | — | 60.0 | 99.9 |
| 9 | 96.75 | 1.00 | 0.25 | 1.00 | 1.00 | 60.0 | 99.7 |
| 10 | 96.75 | 2.00 | 0.25 | 1.00 | — | 60.0 | 99.8 |
| 11 | 96.90 | 1.50 | 0.10 | — | 1.50 | 60.0 | 99.7 |
| 12 | 96.95 | 0.50 | 0.05 | 1.50 | 1.00 | 60.0 | 99.6 |
| 13 | 96.60 | 3.10 | 0.30 | — | — | 60.3 | 99.92 |

The hydroreactive preparation obtained as taught by the invention presents excellent resistance to corrosion in air. The preparation is highly efficient, its hydrogen producing capacity 99.0 to 99.9%. Owing to the low contents of catalyst and zinc in the preparation of the invention and to the simplicity of the procedure by which it is made, the cost of this preparation is significantly less than that of other equivalent materials. The hydroreactive preparation of the invention serves a wide range of applications. It can be used in hydrogen/oxygen combustion cells, as a fuel source for internal combustion engines, in the blowing systems of ballasting systems of submersible vessels and marine salvage pontooms, in gas generators employed in connection with metal cutting, welding and soldering/brazing apparatus, in plasma chemistry, for producing reductive fluid, etc.

What is claimed is:

1. A magnesium alloy capable of inducing generation of hydrogen when reacting with water in the presence of chlorinous salt and being resistant to corrosion in air, said alloy comprising magnesium and minor quantities of one or several metals as catalyst, characterized in that said magnesium alloy comprises:

(a) between 0.4% and 10% by weight nickel as catalyst, and additionally, (b) between 0.015% and 10% by weight zinc as a passivating agent, wherein reaction of said alloy with sea water results in at least a 99% efficiency in the liberation of hydrogen gas, with the liberation of hydrogen being at a rate of at least 10 ml/cm$^2$.min.

2. The magnesium alloy according to claim 1, wherein said magnesium alloy comprises (a) about 0.5 to 3.5% by weight nickel and (b) about 0.02 to 0.5% by weight zinc.

3. The magnesium alloy according to claim 1, wherein said magnesium alloy comprises cobalt as an additional catalyst.

4. The magnesium alloy according to claim 1, wherein said magnesium alloy comprises manganese at an additional catalyst.

5. The magnesium alloy according to claim 1, wherein said magnesium alloy comprises at least one additional catalyst selected from the group consisting of: (a) up to 1.5% by weight cobalt and (b) up to 1.5% by weight manganese.

* * * * *

UNITED STATES PATENT AND TRADEMARK OFFICE

CERTIFICATE OF CORRECTION

PATENT NO. : 5,494,538

DATED : February 27, 1996

INVENTOR(S) : Vladimir I. Kirillov, Alexander N. Vastrebov

It is certified that error appears in the above-indentified patent and that said Letters Patent is hereby corrected as shown below:

Column 1, line 23, replace "though" with --through--

Signed and Sealed this

Twenty-first Day of May, 1996

*Attest:*

Bruce Lehman

BRUCE LEHMAN

*Attesting Officer*

*Commissioner of Patents and Trademarks*